United States Patent [19]

Tyler

[11] 3,993,247

[45] Nov. 23, 1976

[54] ATOMIZERS

[75] Inventor: Terence Tyler, Allestree, England

[73] Assignee: Clarke Chapman Limited, Gateshead, England

[22] Filed: Feb. 27, 1975

[21] Appl. No.: 553,657

[30] Foreign Application Priority Data

Feb. 28, 1974 United Kingdom ..... 9032/74

[52] U.S. Cl. ..... 239/73; 239/126; 137/554

[51] Int. Cl.[2] ..... B05B 12/00

[58] Field of Search ..... 239/71–73, 239/125, 126; 431/15, 17; 137/554

[56] References Cited

UNITED STATES PATENTS

| | | | |
|---|---|---|---|
| 996,110 | 6/1911 | Miller | 137/554 |
| 1,288,968 | 12/1918 | Obenhaus | 137/554 |
| 1,788,703 | 1/1931 | Bushnell | 239/125 |
| 2,549,092 | 4/1951 | Huber | 239/125 |

*Primary Examiner*—Carroll B. Dority, Jr.
*Attorney, Agent, or Firm*—Hall & Houghton

[57] ABSTRACT

A recirculating type atomizer which has a body, a discharge orifice in one end of the body and a lance, movable in the body having a tip for closing the discharge orifice, is provided with electrical circuit means for indicating when the orifice is closed. The circuit means is formed in part by the body and the lance, the rear end of the lance being electrically insulating from the body so that the circuit means is only completed when the tip of the lance closes the orifice.

2 Claims, 2 Drawing Figures

ATOMIZERS

This invention relates to atomisers and has particular reference to atomiser burners of the tip shut-off, recirculating type for use with liquid fuel.

Recirculating burners are well known and it is also known to provide shut-off of the atomiser discharge by a lance whose tip acts in conjunction with the atomiser discharge orifice. Hitherto, it has not been possible to determine whether complete closure of the orifice has occured when the burner is apparently shut down and it is an object of the present invention to provide a construction which allows an indication to be obtained of the fully-shut condition.

According to the present invention, an atomiser of the recirculating type has a discharge orifice, a lance movable within the atomiser and having a tip which, in use, engages with the discharge orifice to shut off the discharge orifice, the atomiser including means for providing an indication when the tip contacts the discharge orifice to close the latter.

In one embodiment of the invention, the tip is electrically isolated from the atomiser orifice except when the latter is closed by the tip, electrical contact between the tip and the orifice completing an electrical circuit for energising an indicating device providing a visual or audible indication that the orifice is closed.

Figure 1:
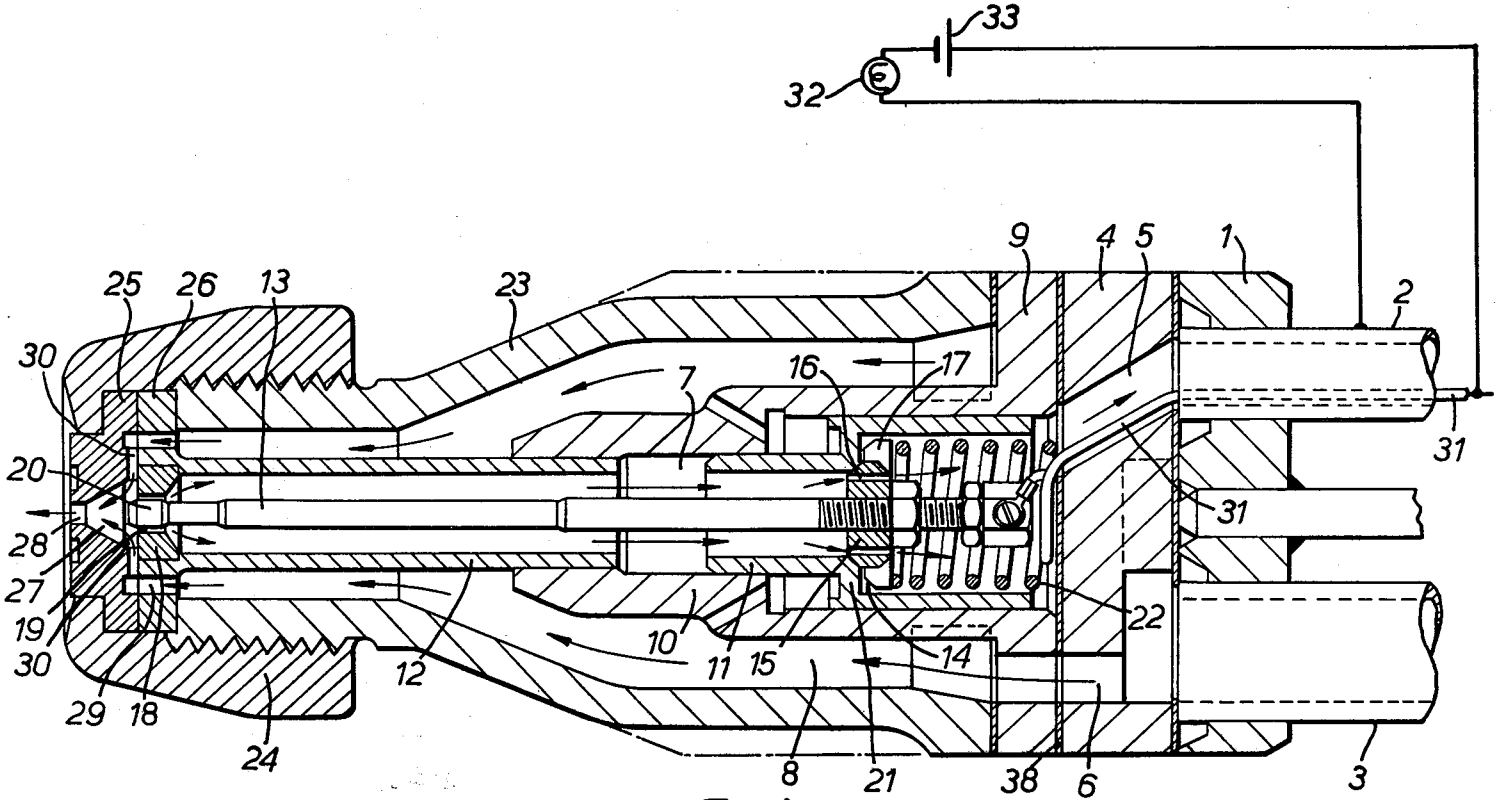
Figure 2:
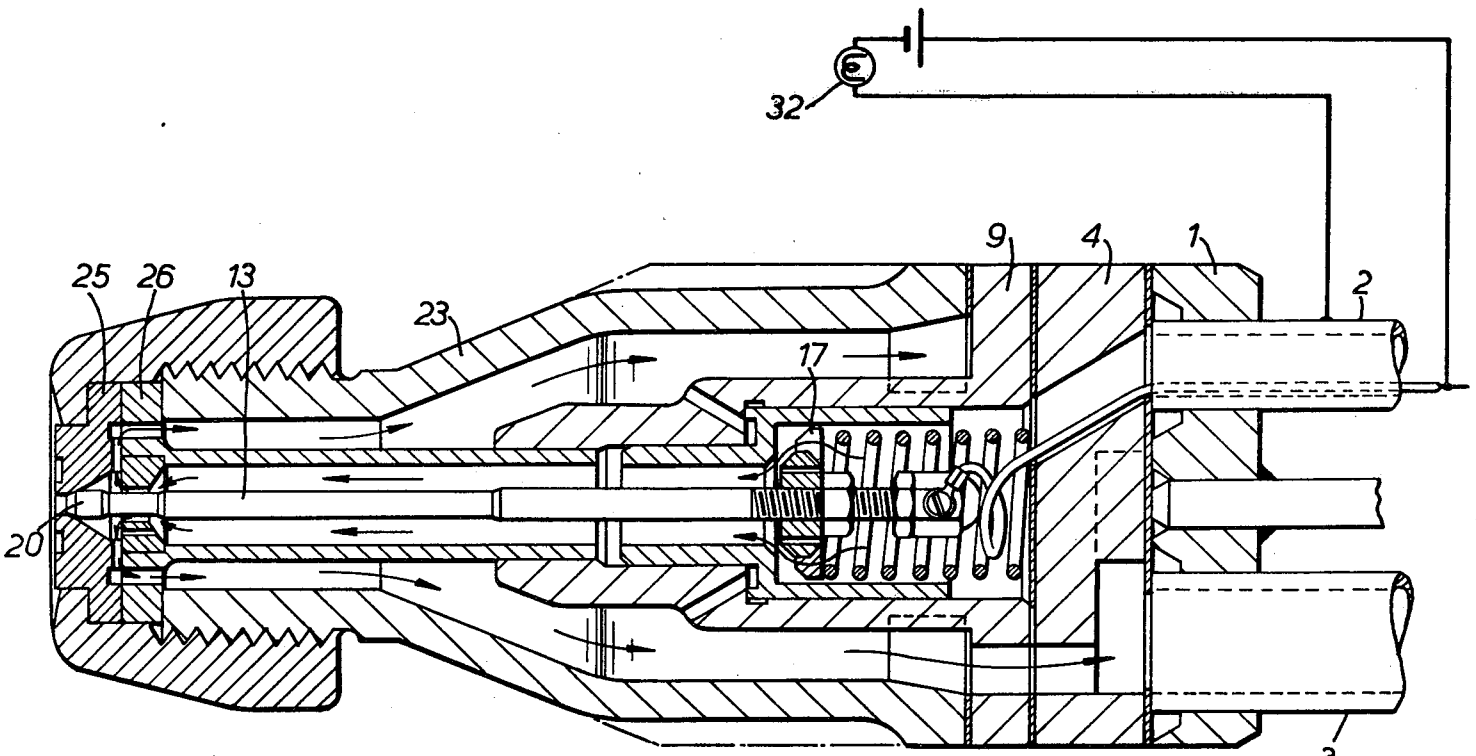

By way of example only, a tip-shut-off, recirculating burner for liquid fuel will now be described in greater detail with reference to the accompanying drawings of which:

FIGS. 1 and 2 are cross-sections of the burner in its fully open and closed positions respectively.

The burner is of generally conventional construction comprising an end plate 1 in which fuel flow pipes 2 and 3 terminate. Attached to the end plate 1 is a distribution plate 4 apertured at 5 and 6 to provide communication from the pipes 2 and 3 to fuel flow passages 7, 8 respectively in the body of the burner.

Mounted upon the distribution plate 4 is a piston housing 9 having a central hollow boss 10 which accommodates a piston 11 and from which projects a tubular extension 12.

Located co-axially with respect to the boss 10 and extension 12 is a lance 13 one end of which is secured to a spider 14 located within the piston 11. The spider 14 is of electrically-insulating material and has a central portion 15 with flow passages 16 and radially-extending guides 17. Mounted at one end of the extension 12 is a plug 18 of electrically-insulating material, the plug having a central aperture 19 able to receive with clearance the tip 20 of the lance 13. With the components in the positions shown in FIG. 1, the spider 14 is maintained in contact with a shoulder 21 of the piston 11 by a spring 22.

As can be seen from the drawings, the fuel passage 8 is located between the boss 11, the extension 12 and an outer body 23 one end of which abuts the distribution plate 4 while there is screwed over the other end a retaining ring 24 which holds in position an orifice plate 25 and a feed tube 26. The orifice plate 25 has a central swirl chamber 27 leading to a discharge orifice 28. The feed tube 26 has longitudinal fuel passages 29 which communicate with tangential passages 30 formed between the orifice plate 25 and the feed tube 26 which lead to the swirl chamber 27.

Electrically-joined to the lance 13 is an insulated conductor 31 which is, conveniently, led down the fuel flow pipe 2 to emerge at some suitable place for connection to an electric circuit comprising an indicator lamp 32 and a power source shown in the drawings as a battery 33. The circuit is completed by a connection to the body of the burner via the pipe 2.

The burner operates in the well-known manner. Fuel flowing along pipe 3 enters passageway 8 and from thence flows via passages 29 and 30 to the swirl chamber 27 from which it emerges through the discharge orifice 28 as fine droplets in a cone formation. A proportion of the fuel entering the swirl chamber flows back via the clearance between the orifice 19 and the tip 20, through extension 12 and the flow passages 16 in the spider 14 to the pipe 2. This situation is shown in FIG. 1 and it will be seen that the tip 20 is out of contact with the orifice plate 25 and thus indicator lamp 32 is not energised.

In the shut-down position shown in FIG. 2, the fuel flow changes as indicated by the arrows and the lance has moved into a position in which the tip 20 has closed the orifice 28 and in so closing the tip makes electrical contact with the orifice plate 25 and complete the energising circuit of indicator lamp 32 which glows thereby indicating the shut-off position.

I claim:

1. An atomiser of the recirculating type for liquid fuel, which comprises support means, tubular body means having an outer tubular member and an inner tubular member mounted on said support means, said outer and inner members defining a flow path therebetween, orifice means defining a discharge orifice at one end of said body means; a lance located in said inner tubular member of said body member and having at a front end thereof a tip engageable against said orifice means to shut off said discharge orifice; said inner member and said lance defining a flow path therebetween; and carrier means mounted in a rear end of said inner member and supporting said lance at a rear end thereof for endwise movement of said lance relative to said body means; wherein the improvement comprises an electrical circuit means which comprises indicator means and which is partly formed by said body means and said lance, said carrier means comprising insulator means electrically insulating said lance at said rear end from said body means, said circuit means being completed to activate said indicator means by engagement of said orifice means upon endwise movement of said lance to shut off said orifice.

2. An atomiser according to claim 1, in which said carrier means comprises a hollow piston member and resilient means mounted within said piston member to surround said lance and to act between said support means and said insulator means to bias movement of said lance towards said orifice means; said insulator means being secured to said lance to space said lance from said piston member, said insulator means having through passages for liquid fuel flow therethrough.

* * * * *